US006112938A

United States Patent [19]

Apps

[11] Patent Number: 6,112,938

[45] Date of Patent: Sep. 5, 2000

[54] BOTTLE DISPENSER

[75] Inventor: William Patrick Apps, Alpharetta, Ga.

[73] Assignee: Rehrig Pacific Company, Los Angeles, Calif.

[21] Appl. No.: 09/314,536

[22] Filed: May 19, 1999

Related U.S. Application Data

[63] Continuation of application No. 08/953,339, Oct. 17, 1997.

[51] Int. Cl.[7] ..... B65H 3/00

[52] U.S. Cl. ..... 221/194; 221/289; 312/45

[58] Field of Search ..... 221/92, 289, 287, 221/191, 194, 133, 103, 67; 312/42, 45; 211/59.2, 49.1

[56] References Cited

U.S. PATENT DOCUMENTS

| | | | |
|---|---|---|---|
| 2,943,900 | 7/1960 | Van Brunt | 312/45 |
| 5,462,198 | 10/1995 | Schwimmer | 221/194 |

*Primary Examiner*—Kenneth W. Noland
*Attorney, Agent, or Firm*—Brooks & Kushman P.C.

[57] ABSTRACT

A bottle dispenser is configured for storing and dispensing bottles having a neck rim. The dispenser includes a substantially rectangular housing with a central opening formed therein. A bottle carrier lid is secured within the central opening and includes a sloped guide track configured for slidably supporting the neck rims of a plurality of bottles for storing and dispensing the bottles. The guide track is sufficiently sloped to advance bottles along the guide track automatically as bottles are dispensed.

7 Claims, 8 Drawing Sheets

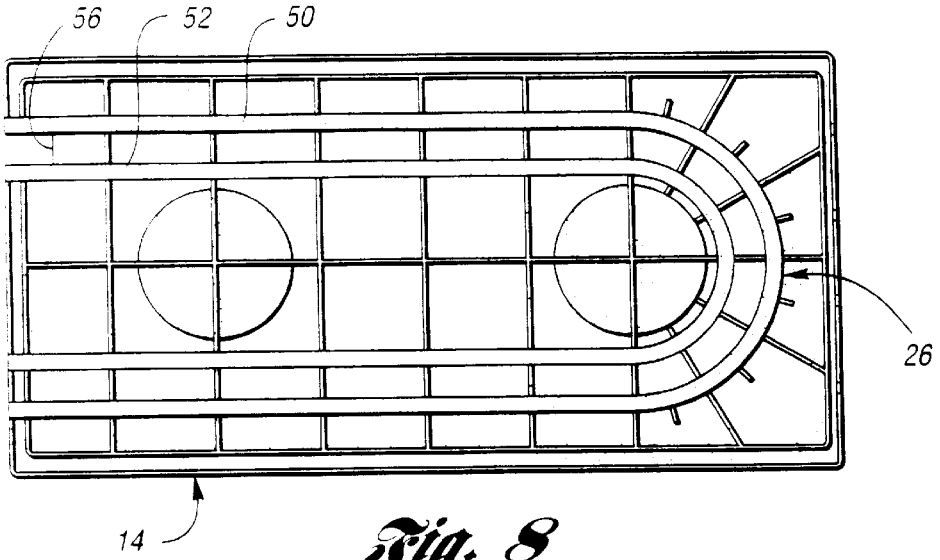
Fig. 8
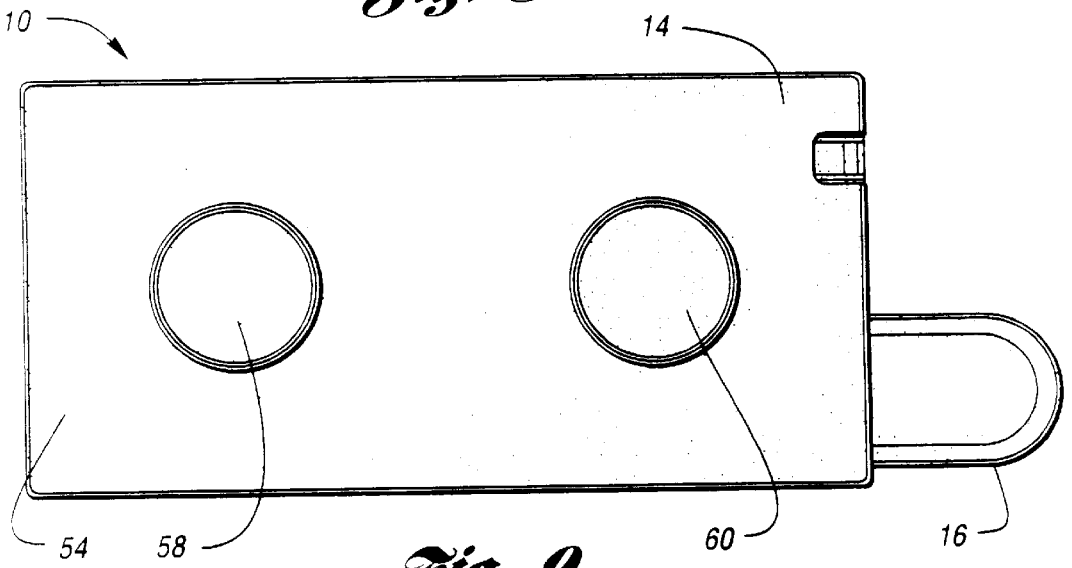
Fig. 9
Fig. 11
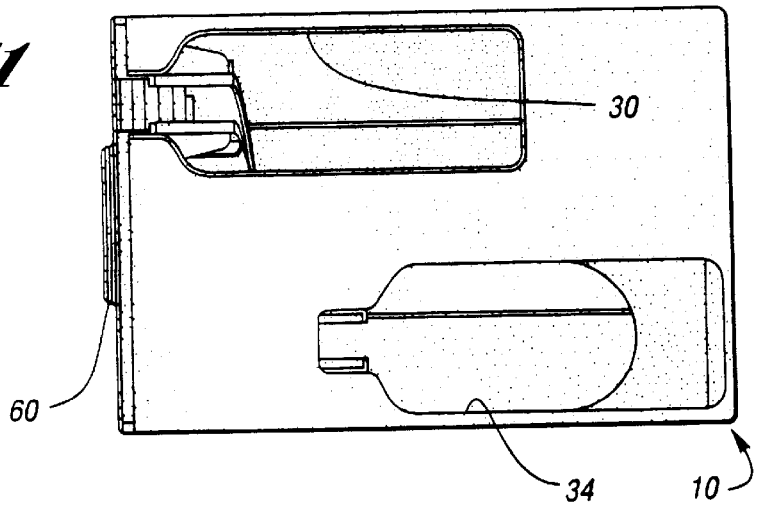

BOTTLE DISPENSER

This Application is a continuation of Ser. No. 08/953,339 filed Oct. 17, 1997.

TECHNICAL FIELD

The present invention relates to a bottle dispenser, and more particularly to a bottle dispenser with a sloped guide track for automatically dispensing stored bottles.

BACKGROUND OF THE INVENTION

Bottles such as two-liter beverage containers are typically shipped in trays or shipping crates, and are loaded manually onto a display rack, shelving unit, or refrigeration display unit at grocery stores or convenience stores for sale. Because the display rack or shelving unit typically does not advance bottles automatically, the display shelves must be periodically rearranged for properly advancing the bottles in order to maintain a neat and effective sales display. Also, the bottles may require reshuffling in order to achieve an appropriate product rotation so that bottles are dispensed generally in the same order in which they are loaded.

Most bottles, particularly plastic bottles, include a neck rim or ring adjacent the bottle cap. So-called "neck-trackers" are used in some refrigeration units for supporting the neck rings and automatically advancing the bottles for display as a result of gravity as bottles are dispensed. However, such neck trackers require rear-loading which is sometimes inconvenient.

It is desirable to provide a bottle storage container which may be used for shipping as well as displaying and dispensing the bottles for sale. It is also desirable to provide a display unit which is front-loaded to allow convenient loading in floor display arrangements. It is further desirable to provide such a bottle storage and display dispenser which receives and dispenses the bottles in an upright position to properly align the bottle labels for convenience in bottle handling.

DISCLOSURE OF THE INVENTION

Accordingly, the present invention provides a stackable bottle dispenser for storing and dispensing bottles which is front-loading and front-dispensing and is configured for use in shipping bottles, as well as for displaying the bottles for sale and dispensing the bottles in an upright position.

More specifically, the present invention provides a bottle dispenser for storing and dispensing bottles having a neck rim. The dispenser includes a substantially rectangular housing with a central opening formed therein. The central opening is adapted to receive a lid. A sloped guide track is further provided. The guide track is configured for slidably supporting the neck rims of a plurality of bottles for storing and dispensing the bottles in an upright position. The guide track is sufficiently sloped to advance bottles along the guide track automatically as bottles are dispensed such that the bottles are dispensed in the order in which they are received.

Preferably, the dispenser is configured for front-loading and front-dispensing of bottles. Also, the dispenser preferably receives and dispenses the bottles in an upright position for handling convenience and for properly displaying graphics on the bottle label. The bottle dispenser is configured for storing, displaying and dispensing one-, two- or three-liter plastic bottles, and is adaptable for dispensing any bottle having a neck ring.

Preferably, the bottle dispenser is configured with corresponding recesses and protrusions on top and bottom surfaces to facilitate stacking of a plurality of bottle dispensers for shipping and for display, and the corresponding recesses and protrusions are arranged to allow cross-stacking of dispensers for sturdiness.

Accordingly, an object of the present invention is to provide a bottle dispenser for storing, displaying and dispensing bottles at the point of sale.

Another object of the present invention is to provide a bottle dispenser configured with a sloped guide track for supporting the neck rim of two liter bottles for automatically advancing the bottles as bottles are dispensed for proper product rotation.

A further object of the invention is to provide a bottle dispenser configured for front-loading and front-dispensing, and which receives and dispenses the bottles in a vertical position for handling convenience and label display.

Yet another object of the present invention is to provide a bottle dispenser for storing and dispensing plastic bottles which includes corresponding protrusions and recesses on top and bottom surfaces to facilitate stacking of a plurality of like bottle dispensers for storage and display, and to allow cross-stacking of dispensers.

The above objects and other objects, features and advantages of the present invention are readily apparent from the following detailed description of the best mode for carrying out the invention when taken in connection with the accompanying drawings.

BRIEF DESCRIPTION OF THE DRAWINGS

FIG. 8 shows an under side view of the bottle carrier lid of FIG. 5;

FIG. 9 shows a top plan view of the bottle dispenser of FIG. 1;

FIG. 11 shows an end view of the bottle dispenser of FIG. 9;

DETAILED DESCRIPTION OF THE PREFERRED EMBODIMENTS

Figure 1:
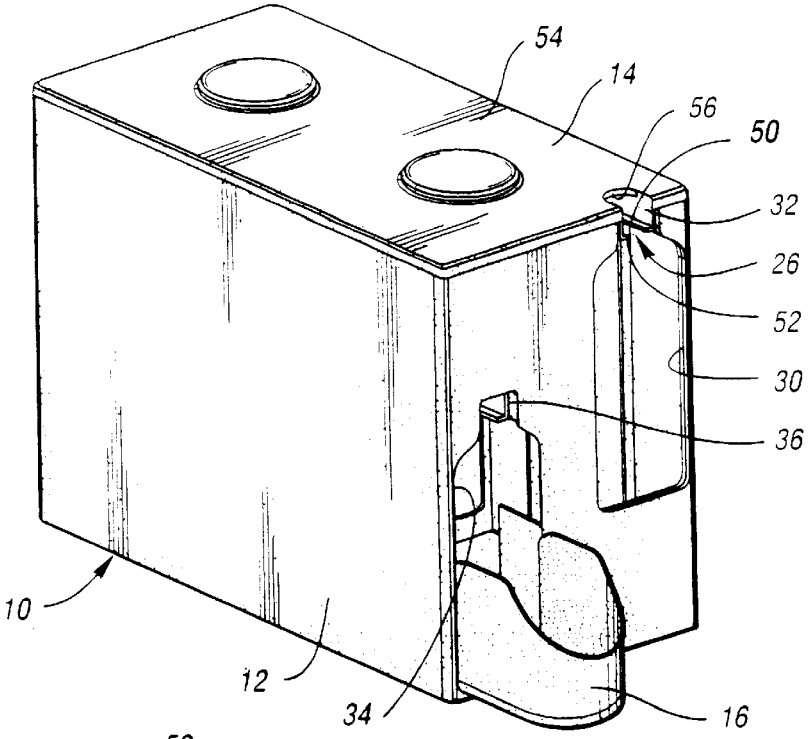
FIG. 1 shows a perspective view of a bottle dispenser in accordance with the present invention.
Figure 2:
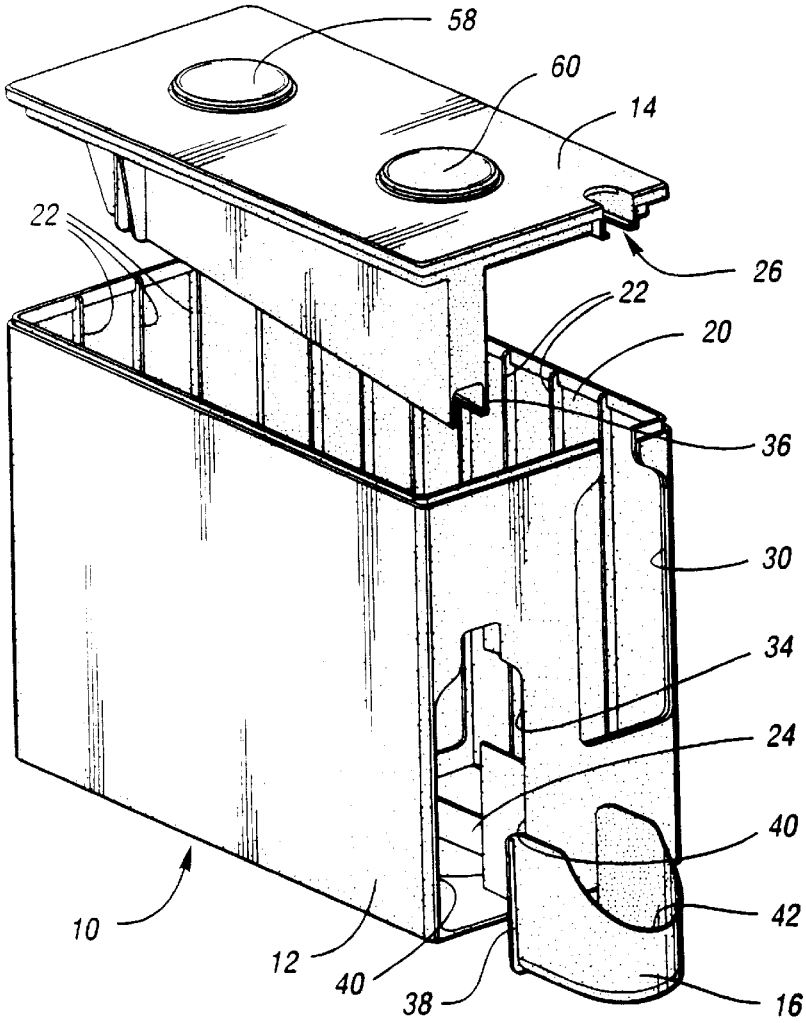
FIG. 2 shows an exploded perspective view of the bottle dispenser of FIG. 1.
Figure 3:
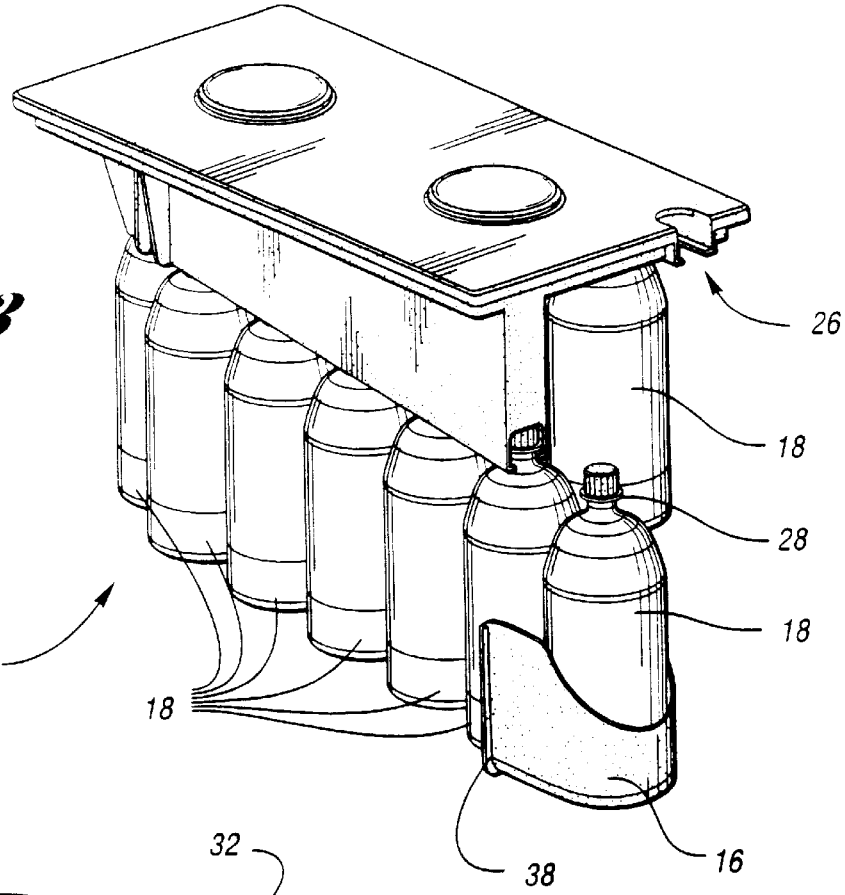
FIG. 3 shows a partially disassembled perspective view of a bottle dispenser with bottles in accordance with the present invention.

Referring to FIGS. 1–3, a bottle dispenser 10 is shown in accordance with the present invention. The bottle dispenser 10 comprises a substantially rectangular housing 12, a bottle carrier lid 14 secured to the housing, and a display basket 16 extending from the housing 12 for displaying bottles 18. Housing 12, lid 14, and basket 16 are preferably, but not necessarily, comprised of plastic. Other suitable materials such as wood, cardboard, and metal are of course contemplated.

The substantially rectangular housing 12 includes a central opening 20 formed on a top portion thereof. The bottle carrier lid 14 is secured within the central opening 20. The housing 12 may be provided with a plurality of support ribs 22,24 or other suitable reinforcement for added structural integrity. The size and spacing of ribs 22,24 are of course selected based on the materials used, the application, and other design considerations within the purview of one skilled in the art.

A sloped guide track 26 is provided. Guide track 26 is adapted to be secured to the dispenser 10. In a preferred embodiment, guide track 26 is affixable to lid 14. It is contemplated, however, that other arrangements will be used. For example, guide track 16 may be affixed to housing 12. Guide track 16 is configured for slidably supporting the neck rims 28 of the plurality of bottles 18 for storing and dispensing the bottles 18. The guide track 26 is sufficiently sloped to advance the bottles 18 along the guide track 26 automatically as bottles are dispensed to provide proper product rotation. As discussed in further detail below, the slope is generally less than 10° and preferably within the range of 5° to 10°. In the preferred embodiment, 7° is selected. Other slopes are of course contemplated depending on the particular application.

The housing 12 also includes a first aperture 30 positioned adjacent the first end 32 of the sloped guide track 26 to facilitate insertion of bottles 18 into the dispenser 10. The housing 12 further includes a second aperture 34 positioned adjacent the second end 36 of the sloped guide track 26 to facilitate bottle dispensing.

The display basket 16 is positioned within the second aperture 34 of the housing 12, and includes opposing flanges 38 for engagement along the peripheral edge 40 of the second aperture 34. The display basket 16 includes a low-cut front portion 42 to facilitate display of the label on the particular bottle 18 being displayed in the basket 16. The basket 16 is preferably a clear polycarbonate material. As noted above, however, other suitable materials such as cardboard, metal, wood, etc., are contemplated. Of course, the configuration of the display basket 16 may vary significantly within the scope of the present invention. For example, the display basket may be sloped or angled to enable various presentation arrangements for the bottle, such as presenting the bottle horizontally.

Turning to FIGS. 4–8, the bottle carrier lid 14 is shown in greater detail. As shown in FIG. 8, the guide track 26 is substantially U-shaped. The second end 36 of the guide track 26 is positioned at a lower vertical position than the first end 32 of the guide track 26 when assembled. In a preferred embodiment, ends 32 and 36 are spaced apart vertically and horizontally. Of course, other spacing relationships are contemplated based on the materials selected and the particular application.

Figure 4:
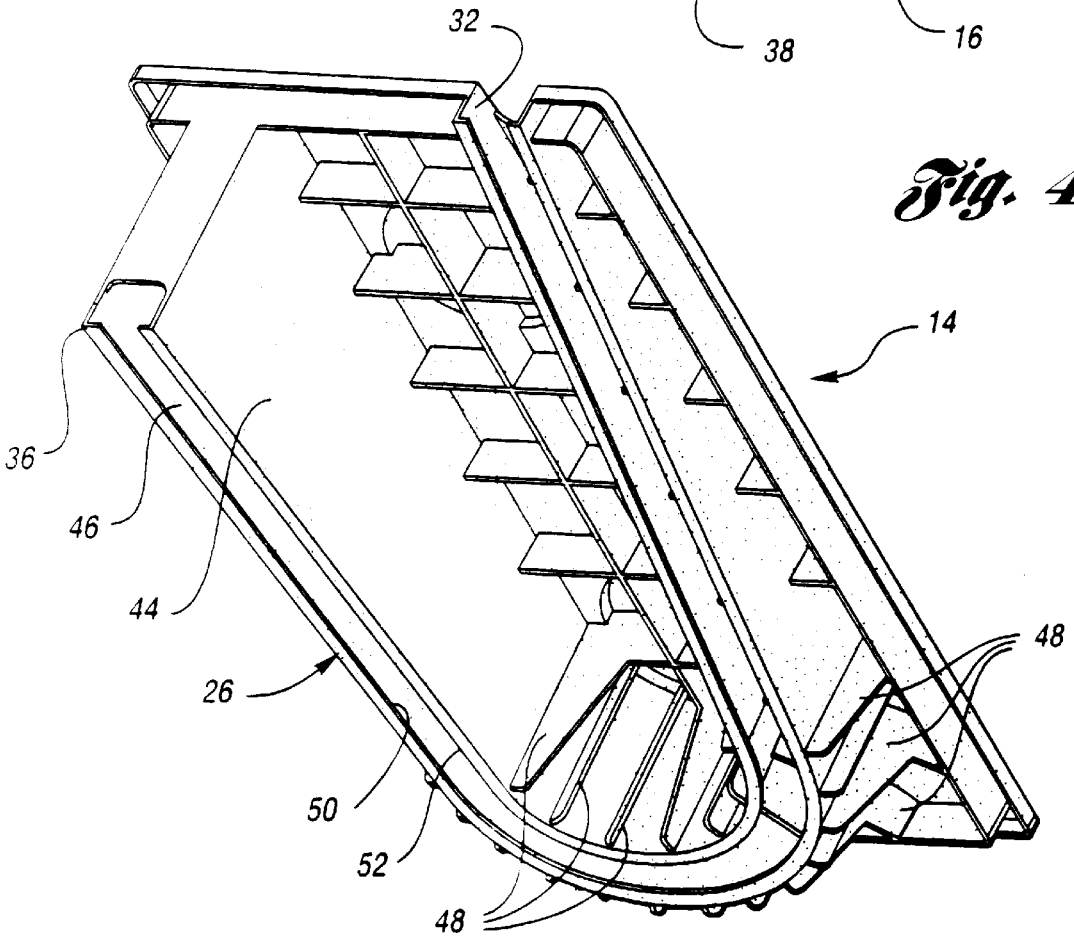
FIG. 4 shows a perspective view of a bottle carrier lid in accordance with the present invention.
Figure 7:
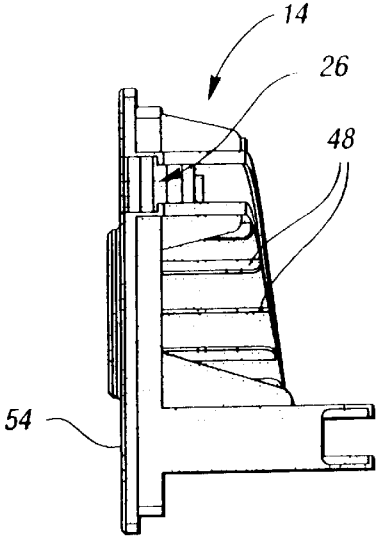
FIG. 7 shows an end view of the bottle carrier lid of FIG. 5.

The guide track 26 includes side walls 44,46, shown in FIG. 4, which are supported by a plurality of support ribs 48. The side walls 44 include a pair of opposing flanges 50,52 for engaging the neck rims 28 of the bottles 18. The opposing flanges 50,52 form a channel therebetween for receiving the necks of the bottles 18. Of course, the flanges 50,52 present a molding challenge, so the flanges 50,52 may be molded and attached separately to the walls 44, or the walls 44 and flanges 50,52 could be formed together and attached to the lid as separate components. Alternatively, the lid 14 could be molded as two components separated along the channel between the flanges. Various configurations are contemplated.

Figure 6:
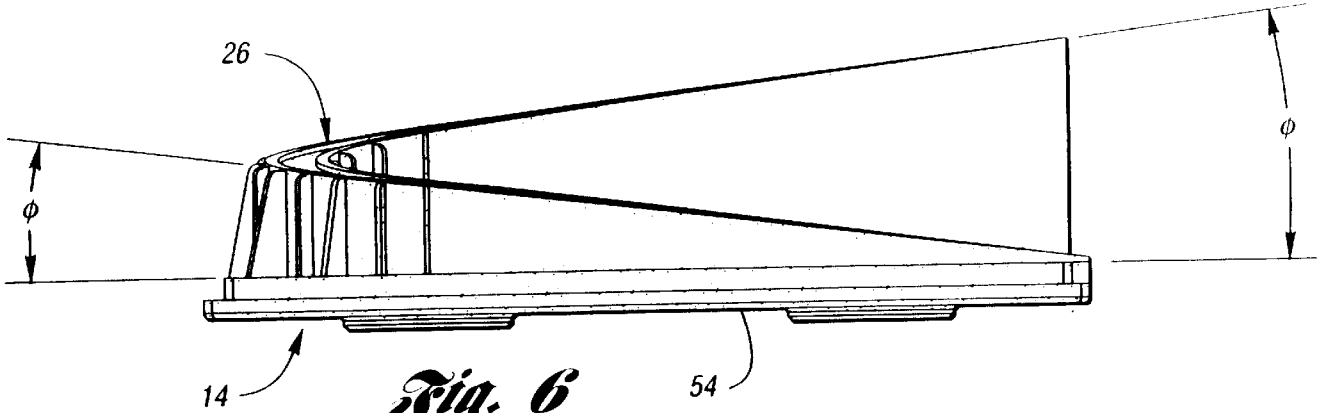
FIG. 6 shows a side view of the bottle carrier lid of FIG. 5.

As shown in FIG. 6, the guide track 26 is sloped at an angle θ with respect to the substantially flat upper portion 54 of the bottle carrier lid 14. The angle θ is preferably approximately 7°, or within the range of 5 to 10°. The angle θ is appropriately selected to automatically advance bottles along the guide track 26 as bottles are dispensed from the basket 16. It is to be understood that angle θ may vary depending on the particular application and the materials selected without deviating from the scope and spirit of the invention.

In order to enhance the sliding action of the bottles along the flanges 50,52, the flanges 50,52 may be coated with a slippery material. Alternatively, the flanges 50,52 may comprise a plastic material having a low coefficient of friction to enhance sliding, such as a high-impact polystyrene with a silicone additive.

Figure 5:
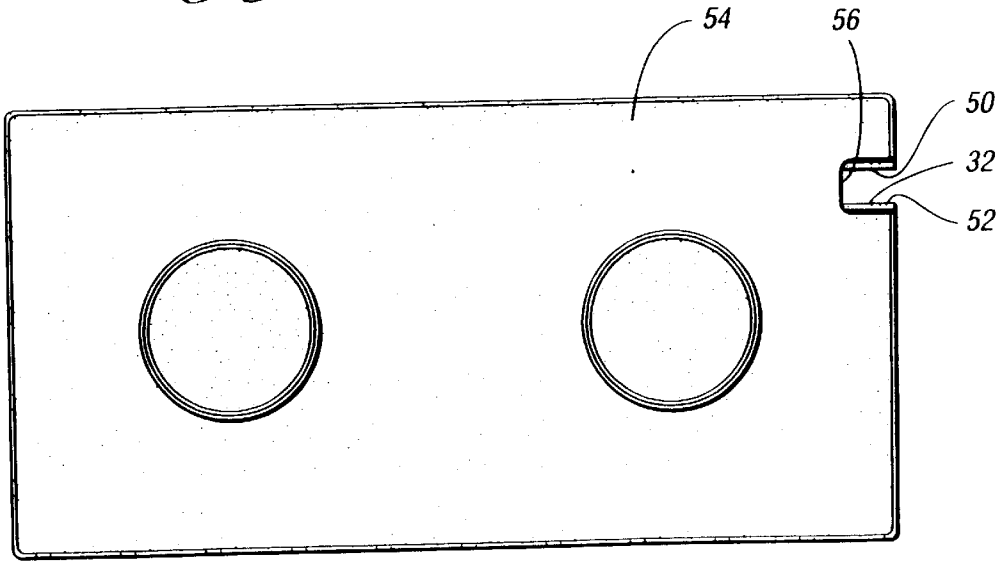
FIG. 5 shows a top plan view of the bottle carrier lid of FIG. 4.
Figure 10:
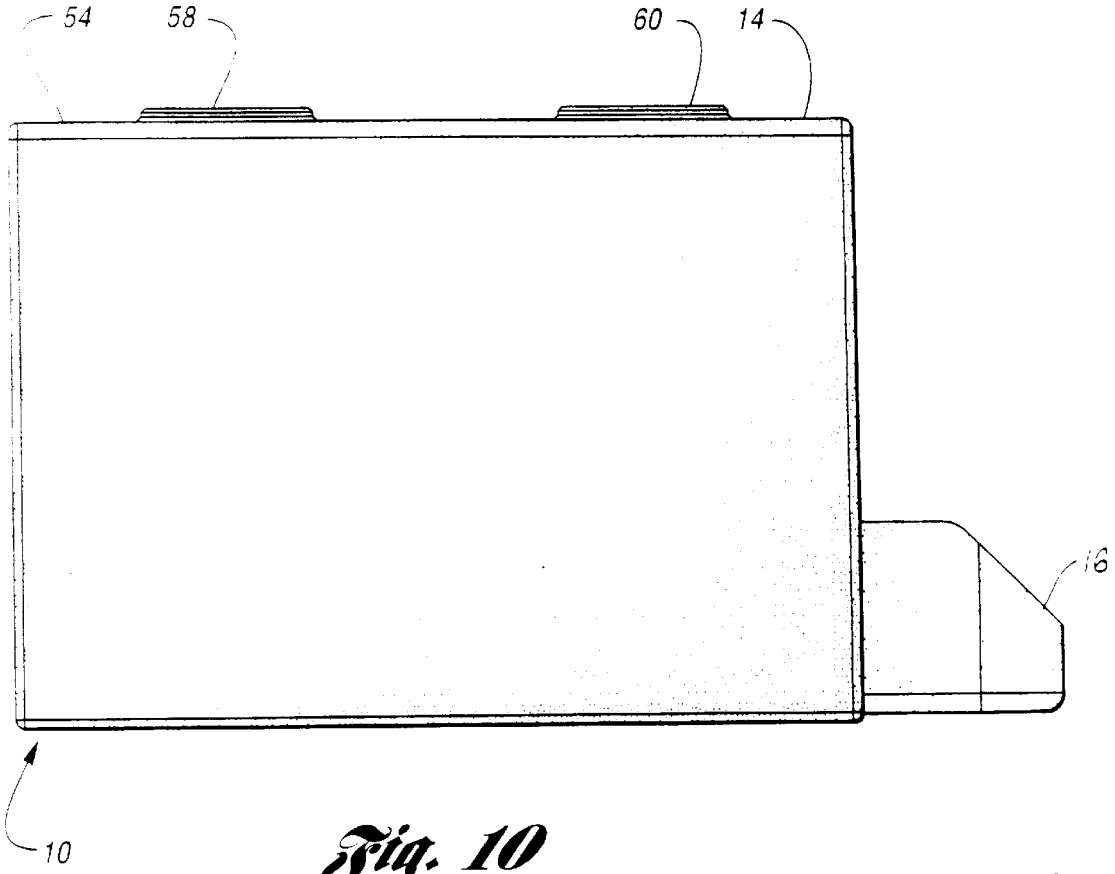
FIG. 10 shows a side view of the bottle dispenser of FIG. 9.

As most clearly shown in FIGS. 1 and 5, the upper portion 54 includes a cut-out 56 directly above the first end 32 of the guide track 26 to allow clearance for the bottle cap of the bottle 18 as the bottles are inserted into the first end 32 of the guide track 26.

Figure 12:
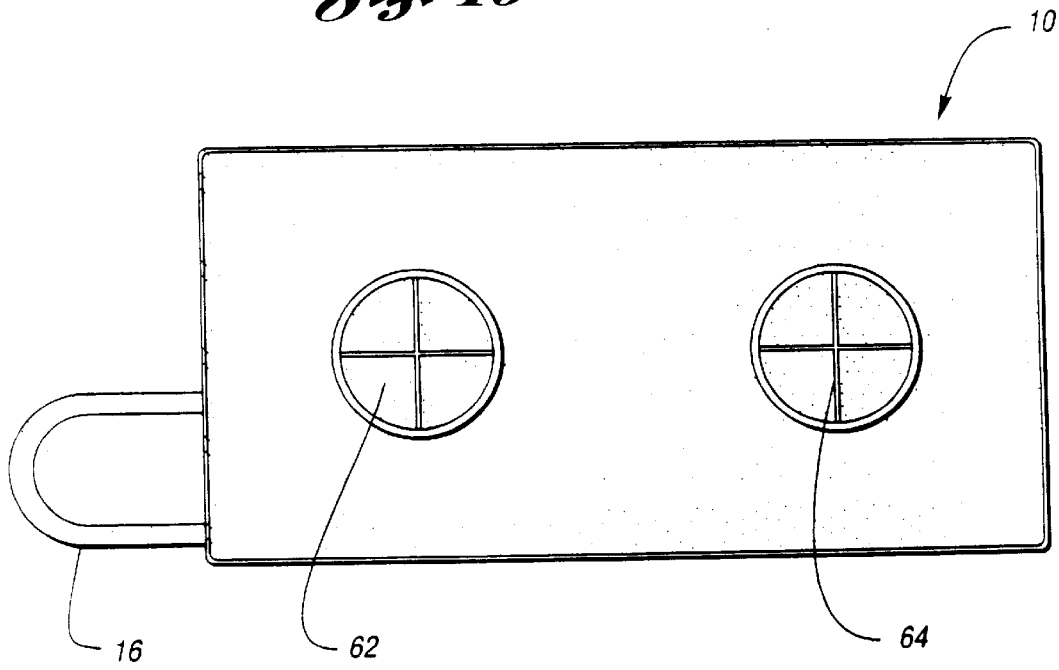
FIG. 12 shows a bottom view of the bottle dispenser of FIG. 9.

Turning to FIGS. 9–12, the bottle carrier lid 14 is provided with a pair of protrusions 58,60 extending from the substantially flat upper portion 54. Similarly, the housing 12 is provided with a pair of corresponding recesses 62,64, as shown in FIG. 12 for cooperation with the protrusions 58,60 to allow stacking of the bottle dispensers 10, as shown in FIG. 13.

Figure 13:
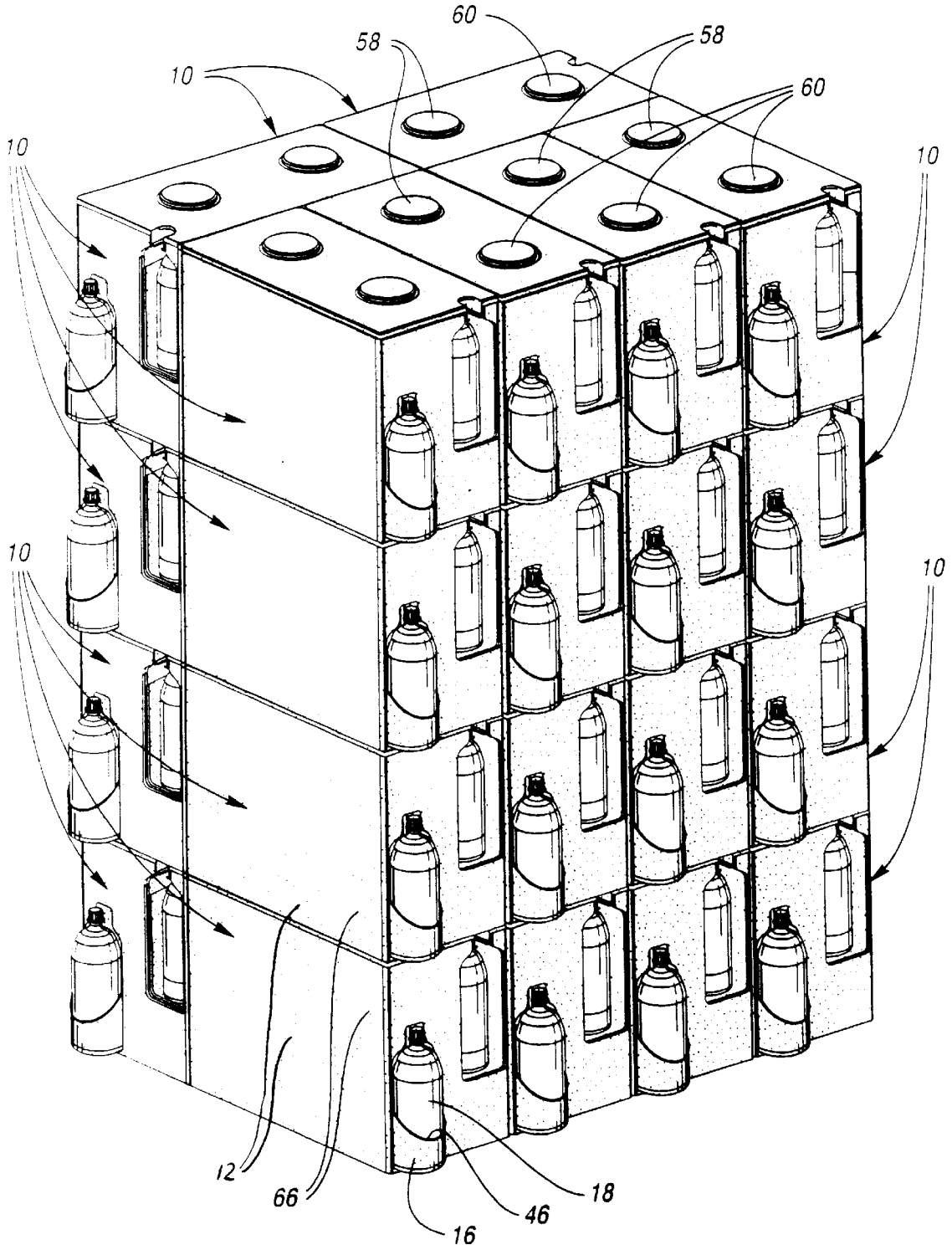
FIG. 13 shows a perspective view of a plurality of stacked bottle dispensers in accordance with the present invention.

As shown in FIG. 13, the dispensers 10 may be stacked by means of the corresponding protrusions 58,60 and recesses 62,64. The arrangement shown in FIG. 13 is desirable as a display configuration for display at the point of sale. The side walls 66 of the housings 12 may be used to prominently display advertisements for the particular beverage being dispensed. Furthermore, as shown in FIG. 13, the low-cut front portion 42 of the display basket 16 allows the label of each bottle 18 to be prominently displayed.

Accordingly, the present invention provides a bottle dispenser for storing and dispensing bottles in a dispenser configuration which is easily stackable, and which is configured for front-loading and front-dispensing of bottles in an upright position. The particular dispenser configuration described is adaptable for use as a display set up in a store, and is also convenient for shipping and storage of such bottles. The present invention is intended for use with two liter bottles, but may be applicable to other similar items.

A special feature of the invention is that in order to alter the dispenser configuration for differently sized bottles, only the lid 14 must be replaced with a differently sized guide channel.

The housing 12 could include side openings to facilitate access for removing bottles jammed in the guide track. Also, the guide track could include a lead-in ramp and funnel for ease of insertion into the guide track.

The present invention also contemplates the use of marked labels for properly orienting the bottles when inserted in order to achieve proper orientation of the label on the dispensed bottle after it has traveled the length of the guide track. Non-cylindrical bottles may be guided by guide rails along the guide track for appropriate label display.

The present invention further contemplates that the basket 16 may be slid into the housing, forcing the bottles upward along the guide track, for shipping of the dispensers.

In an alternative embodiment, the bottles could be side-loaded or rear-loaded, and sloped guide tracks provided for feeding two dispenser baskets at the front of the dispenser.

Figure 14:
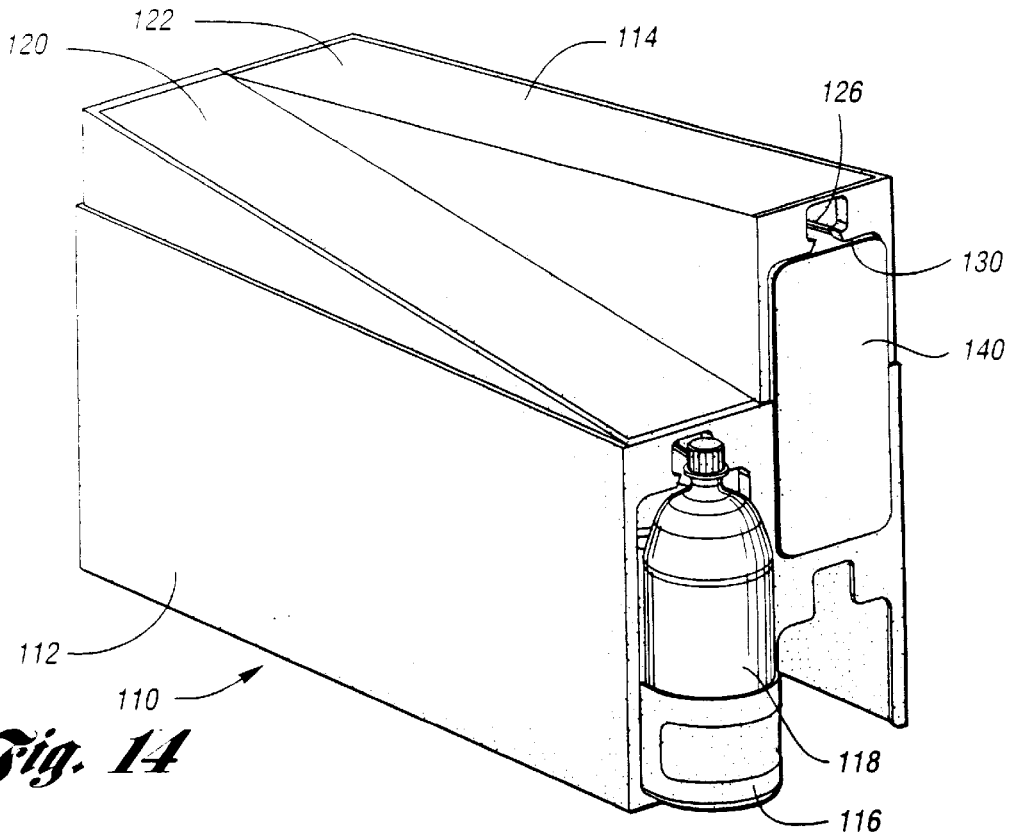
FIG. 14 shows a perspective view of a bottle dispenser in accordance with an alternative embodiment of the invention.
Figure 15:
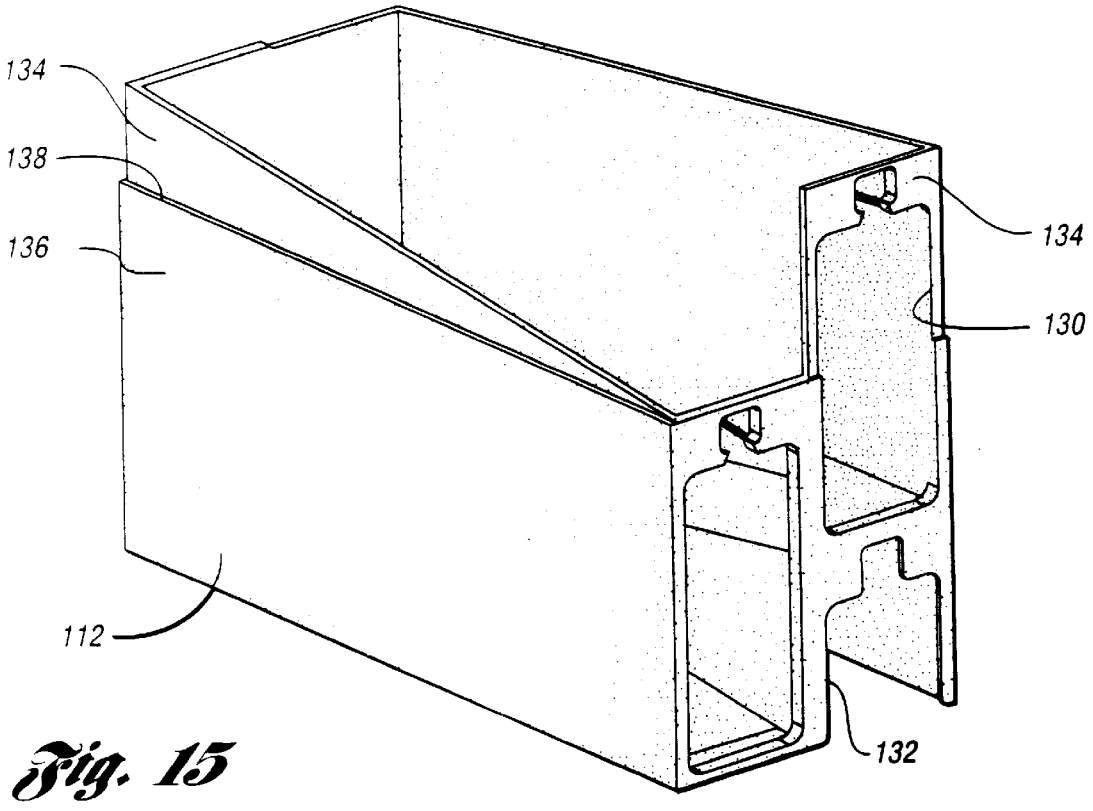
FIG. 15 shows a perspective view of a housing for use with the embodiment shown in FIG. 14.
Figure 16:
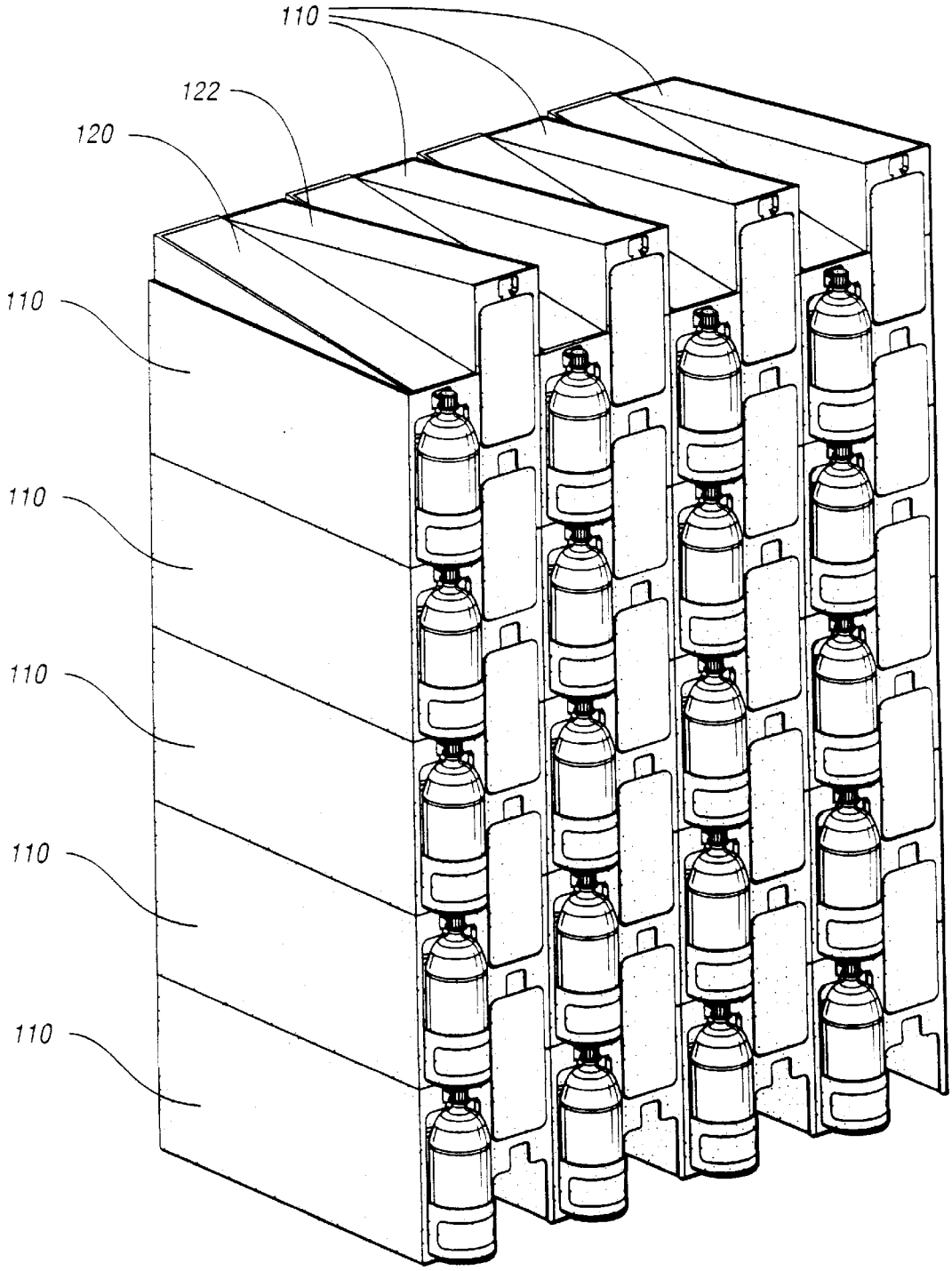
FIG. 16 shows a perspective view of a plurality of stacked bottle dispensers in accordance with the embodiment shown in FIG. 14.

FIGS. 14–16 show a further alternative embodiment of the invention in which the housing and lid are sloped to match the slope of the guide track for conserving space in a stacked assembly. As shown, the bottle dispenser 110 includes a housing 112, a bottle carrier lid 114 mounted on top of the housing 112, and a display basket 116 for displaying the bottles 118. In this configuration, the bottle carrier lid 114 includes sloped top surfaces 120,122 with slopes corresponding with the slope of the guide track 126.

The housing 112 is more clearly shown in FIG. 15. As shown, the housing 112 is provided with a receiver opening 130 and a clearance opening 132. The upper portion 134 of the housing 112 is slightly inset with respect to the lower portion 136 of the housing 112 above the peripheral lip 138. This enables stacking of adjacent housings by inserting the upper portion 134 of one housing into the lower portion of an adjacent housing as like bottle dispensers 110 are stacked on top of each other.

Returning to FIG. 14, a door 140 is provided over the receiver opening 130 for providing an additional advertisement surface and for enclosing the bottles 118 within the housing 112. The door 140 is hinged within the receiver opening 130.

FIG. 16 shows a plurality of stacked bottle dispensers 110 in accordance with the embodiment shown in FIG. 14, arranged as a floor display unit. The respective sloped surfaces 120,122 of the lids of each bottle dispenser 110, as well as the recessed upper portion 134 of the housing 112 of each bottle dispenser 110, as described with reference to FIG. 15, enables such stacking. In this arrangement, storage efficiency is improved by minimizing the amount of wasted space within the dispensers 110.

While the best modes for carrying out the invention have been described in detail, those familiar with the art to which this invention relates will recognize various alternative designs and embodiments for practicing the invention within the scope of the appended claims.

What is claimed is:

1. A bottle dispenser for dispensing bottles having a neck rim, the dispenser comprising:

a substantially rectangular housing with a central opening formed on a top portion thereof, the central opening receiving a bottle carrier lid covering the central opening; and a sloped guide track supported by the bottle carrier lid within the housing and configured for slidably supporting the neck rims of a plurality of bottles for receiving, storing and dispensing the bottles in an upright position, wherein the guide track is sufficiently sloped to advance bottles along the guide track automatically as bottles are dispensed such that the bottles are dispensed in the order in which they are received; and wherein said housing further comprises a first aperture positioned adjacent a first end of the sloped guide track to facilitate insertion of bottles into the dispenser, and a second aperture positioned adjacent a second end of the sloped guide track to facilitate bottle dispensing.

2. The bottle dispenser of claim 1, wherein said guide track is substantially U-shaped with the second end being positioned at a lower vertical position than the first end.

3. The bottle dispenser of claim 1, wherein said bottle carrier lid includes a substantially flat upper portion and said sloped guide track comprises a slope of approximately 5° to 10° with respect to the substantially flat upper portion.

4. The bottle dispenser of claim 3, wherein said bottle carrier lid comprises a single injection molded plastic component.

5. The bottle dispenser of claim 1, further comprising a bottle display basket extending from the second aperture, and wherein the bottle dispenser comprises only three injection molded parts.

6. The bottle dispenser of claim 3, wherein the housing and substantially flat upper portion of the bottle carrier lid include a mating recess and protrusion respectively to facilitate stacking of a plurality of bottle dispensers.

7. The bottle dispenser of claim 1, wherein said sloped guide track comprises a pair of opposing flanges for engaging the neck rims, wherein the opposing flanges form a channel therebetween for receiving the necks of the bottles.

* * * * *